US007051821B2

(12) United States Patent
Samuel

(10) Patent No.: US 7,051,821 B2
(45) Date of Patent: May 30, 2006

(54) ADJUSTABLE HOLE CLEANING DEVICE

(75) Inventor: Robello Samuel, Houston, TX (US)

(73) Assignee: Halliburton, Houston, TX (US)

( * ) Notice: Subject to any disclaimer, the term of this patent is extended or adjusted under 35 U.S.C. 154(b) by 0 days.

(21) Appl. No.: 10/740,349

(22) Filed: Dec. 18, 2003

(65) Prior Publication Data

US 2005/0133269 A1 Jun. 23, 2005

(51) Int. Cl.
*E21B 7/04* (2006.01)

(52) U.S. Cl. ..... 175/61; 175/102; 175/323; 175/313; 166/223

(58) Field of Classification Search ..... 175/61, 175/102, 323, 324, 313; 166/319, 321, 222, 166/223

See application file for complete search history.

(56) References Cited

U.S. PATENT DOCUMENTS

| | | | | |
|---|---|---|---|---|
| 2,228,640 | A * | 1/1941 | O'Neill | 166/223 |
| 2,239,586 | A * | 4/1941 | Appleby | 175/317 |
| 2,765,146 | A * | 10/1956 | Williams, Jr. | 175/317 |
| 4,361,193 | A * | 11/1982 | Gravley | 175/61 |
| 6,065,541 | A * | 5/2000 | Allen | 166/318 |
| 2005/0000692 | A1* | 1/2005 | Cook et al. | 166/300 |

OTHER PUBLICATIONS

Clark, R.K.; Bickman, K.L. "A Mechanistic Model for Cuttings Transport" 69th SPE Annual Technical Conference and Exhibition 1994, paper SPE 28306.

Larsen, T.I., Pilehvari, A.A. and Azar, J.J. "Development of a New Cuttings Transport Model for High—Angle Welbores Including Horizontal Wells," paper SPE 25872, presented at the 1993 SPE Rocky Mountain Regional/Low Permeability Reservoir Symposium, Denver, Colorado, Apr. 12-14.

Rabia, H. Rig hydraulics 1989, chapter 5.

"Reduction of Annular Friction Pressure Drop Caused by Drillpipe Rotation" SPE 20305, 1989.

(Continued)

*Primary Examiner*—Kenneth Thompson

(74) *Attorney, Agent, or Firm*—Merchant & Gould

(57) ABSTRACT

An adjustable hole cleaning device is provided for cleaning a hole in a subterranean formation. A drillstring containing the device is rotated to drill a hole through the subterranean formation. While rotating the drillstring, drilling fluid is circulated through the drillstring and the device into the hole. In response to an increase in a hydrostatic pressure of the fluid in the drillstring, cleaning elements are extended from the device to clean accumulated cuttings from the drilled hole. The cleaning elements may clean the accumulated cuttings by agitating the circulating fluid in the hole. In response to a decrease in a hydrostatic pressure of the fluid in the drillstring, the cleaning elements may be retracted back into the device. The device may also include a set of ports which hydraulically open in response to the increase of hydrostatic pressure in the drillstring to disperse drilling fluid into the hole for cleaning accumulated cuttings. The device may be deactivated by dropping an object, such as a ball, into the device to prevent the extension of the cleaning elements and the opening of the ports.

25 Claims, 12 Drawing Sheets

OTHER PUBLICATIONS

Ford, J.T.; et al. "Experimental Investigation of Cuttings Transport in inclined Boreholes" SPE 20421, 1990.
Martin, M.; et al. "Transport of Cuttings in Directional Wells" SPE/ADC 16083, 1987.
Stifferman, T.R.; Becker, T. "Hole Cleaning in full Scale inclined Wellbores" SPEDE Jun. 1992.
Walker, R.E. "Migration of Particles to a Hole . . . " SPE Journal Jun. 1969, pp. 147-154.

* cited by examiner

ADJUSTABLE HOLE CLEANING DEVICE

TECHNICAL FIELD

The present invention is related to the drilling of holes in subterranean formations. More particularly, the present invention is related to the use of an adjustable hole cleaning device for cleaning cuttings accumulated in a wellbore during well drilling operations.

BACKGROUND

Well drilling operations in subterranean formations, such as those directed to producing oil, typically require circulating a drilling fluid (i.e., mud) through a drilling fluid circulation system. The circulation system may include a drilling rig for supporting lengths of drill pipe ("drillstring") that are fastened to a drill bit and a mud pump. During drilling operations, the drilling fluid may be pumped by the mud pump through the interior of the drillstring, through the drill bit, and returned to the surface through the annulus (i.e., the area between the outside of the drill pipe and the well wall). The drilling fluid cools the drill bit and cakes the sides of the well helping to keep the well from caving in until steep pipe or cement is put in place when the well is completed. Moreover, the weight of the drilling fluid prevents any oil, gas, or water in the subterranean formation from gushing out through the well to the surface.

One of the primary functions of the drilling fluid is to carry "cuttings" (e.g., rock chips or gravel) generated by the drill bit back to the surface so that the hole or wellbore is cleaned efficiently. However, when drilling deviated (i.e., greater than 30 degrees) and extended reach wells, the drilling fluid is ineffective in carrying away drilled cuttings which tend to accumulate in the lower side of the annulus. These accumulated cuttings may eventually form a temporary or permanent "cuttings bed" resulting in pipe sticking, as well as increased torque and drag on the drillstring. Furthermore, failure to clean the accumulated cuttings may lead to formation hole fill-ups, fractured formations, decreased drill bit life, slower rate of penetration, and an increase in the annular density of the hole. Moreover, the cuttings concentration in these wells causes additional annulus equivalent circulating density ("ECD") which may result in a loss of fluid flow up the annulus due to changes in hydrostatic pressure.

One previous solution to the above-described problems required rotating the drillstring while drilling deviated holes to influence cuttings transport, so that the cuttings are dispersed into the higher fluid velocity region of the hole by the mechanical stirring action of the drillstring. However, drillstring rotation has been proven to be ineffective at cleaning accumulated cuttings which have formed a permanent cuttings or "dead" bed in the deviated hole. In order to solve this problem special "downhole" cleaning tools have been developed which are attached to the drillstring during drilling. These downhole cleaning tools typically have fixed external blades and use the rotation and/or reciprocation (i.e., alternatively raising and lowering) of the drillstring so that the fixed blades assist in the removal of dead bed cuttings from the wellbore. These downhole cleaning tools, however, are useless in non-accumulating cuttings areas (i.e., outside of the dead bed) as the fixed blades unnecessarily increase the torque and drag on the drillstring thus reducing the circulation of the drilling fluid and consequently overall cleaning effectiveness in these non-accumulating areas.

It is with respect to these considerations and others that the present invention has been made.

SUMMARY OF THE INVENTION

In accordance with embodiments of the present invention, the above and other problems are solved by providing an adjustable hole cleaning device for cleaning a hole in a subterranean formation. In certain embodiments, the adjustable hole cleaning device includes retractable vanes which are hydraulically activated to clean cuttings from a hole when the tool is in an accumulated cuttings area or "cuttings bed," and hydraulically deactivated when the tool is in a non-accumulated cuttings area to continue effectively cleaning the hole. Other embodiments provide for a set of port holes in the adjustable hole cleaning device which hydraulically open to disperse fluid for cleaning accumulated cuttings in a cuttings bed.

According to one embodiment, a method is provided for cleaning a hole in a subterranean formation. The method includes rotating a drillstring containing a cleaning device to drill a hole through the subterranean formation. While rotating the drillstring, fluid is circulated through the drillstring and the cleaning device into the hole. In response to an increase in a hydrostatic pressure of the fluid in the drillstring, cleaning elements are extended from the cleaning device to clean accumulated cuttings from the drilled hole.

The cleaning elements may be extended from the cleaning device when the hydrostatic pressure of the fluid in the drillstring exceeds a spring tension force in the cleaning device. The cleaning elements may clean the accumulated cuttings by agitating the circulating fluid in the hole. In response to a decrease in a hydrostatic pressure of the fluid in the drillstring, the cleaning elements may be retracted into the cleaning device when a spring tension force in the cleaning device exceeds the hydrostatic pressure of the fluid in the drillstring. The drilled hole may be a deviated hole and the deviation may be greater than 30 degrees.

According to another embodiment, a method is provided for cleaning a wellbore through a subterranean formation. The method includes rotating a drillstring having a cleaning device to drill a well through the subterranean formation. While rotating the drillstring, fluid is circulated through the drillstring, the cleaning device, and a drill bit attached to the drillstring into the wellbore. In response to a hydrostatic pressure of the fluid in the drill bit exceeding a spring tension force in the cleaning device, ports are opened in the cleaning device to divert the fluid from the drillstring into the wellbore. The diverted fluid facilitates the removal of accumulated cuttings from the wellbore. The ports in the cleaning device may be closed in response to the spring tension force in the cleaning device exceeding the hydrostatic pressure of the fluid in the drill bit.

According to another embodiment, a method is provided for deactivating a device for cleaning a hole in a subterranean formation. The method includes dropping an object to make contact with an expandable sleeve in the device and in response to the object making contact with the expandable sleeve, pushing the expandable sleeve in a downward direction to expand the expandable sleeve. The expandable sleeve deactivates the device by preventing the extension of a cleaning element in the device when a hydrostatic pressure of fluid in the device exceeds a spring tension force in the device. The object may be a ball, a drop bar, or a cylinder.

According to yet another embodiment, a hole cleaning device is provided. The hole cleaning device includes cleaning elements for cleaning debris from a hole and a body for conducting fluid. The body includes openings for receiving the cleaning elements. The restraining springs are connected to the cleaning elements so that the cleaning elements are restrained at a spring tension. The hole cleaning device further includes a piston block disposed within the body for pushing the restraining springs such that the cleaning elements are extended through the opening in the main body in response to a fluid pressure in the sub-body exceeding the spring tension of the restraining springs.

In response to the spring tension of the restraining spring exceeding the fluid pressure in the sub-body, the restraining springs pull on the cleaning elements such that the cleaning elements are retracted through the openings in the body. The body may also include ports or openings for diverting the fluid from the body into the hole. The main body may further include a top end having a pin connection for receiving the fluid and a bottom end having a box connection for dispersing the fluid. The body may be further capable of rotation. The cleaning elements may be utilized to clean debris from the hole by agitating the fluid and debris in the hole when the body is rotated.

According to yet another embodiment, a system is provided for cleaning cuttings from a wellbore in a subterranean formation. The system includes a drillstring for conducting and circulating fluid, a drill bit connected to an end of the drillstring for receiving the fluid from the drillstring and conducting and circulating the fluid into the wellbore, and cleaning devices attached along a length of the drillstring. Each cleaning device includes adjustable vanes, a main body having grooved openings for receiving the adjustable vanes, and ports for diverting the fluid from the drillstring. Each cleaning device further includes a sub-body, disposed within the main body for receiving the fluid from the main body, a restraining springs disposed within the sub-body and connected to the adjustable vanes to restrain the plurality of adjustable vanes at a spring tension, and a piston block disposed within the sub-body proximate to the restraining springs. When a hydrostatic pressure of the fluid in the drill bit exceeds the spring tension force in the cleaning device, the ports in the cleaning device are opened to divert fluid from the drillstring into the wellbore, and the piston block pushes the restraining springs to extend the adjustable vanes through the grooved openings and outside of the cleaning device to clear the cuttings in the wellbore. When a spring tension force in the cleaning device exceeds the hydrostatic pressure of the fluid in the drill bit, the ports in the cleaning device are closed and the restraining springs retract the adjustable vanes through the grooved openings and back into the cleaning device.

DETAILED DESCRIPTION OF THE INVENTION

Figure 1:
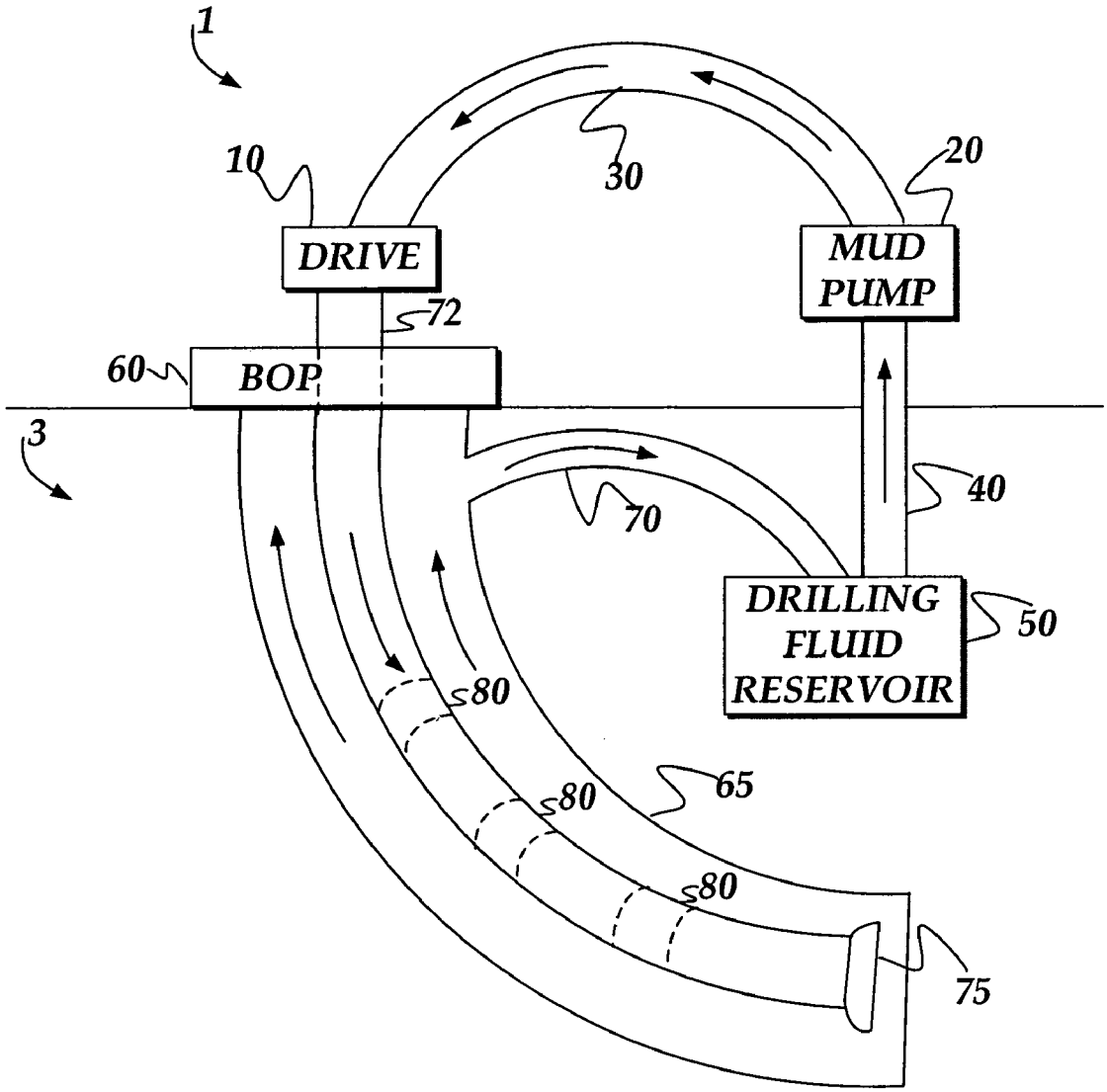
FIG. 1 is a diagram of a suitable drilling system for drilling a wellbore which may be practiced with various embodiments of the invention.

Embodiments of the present invention provide an adjustable hole cleaning device for cleaning a hole in a subterranean formation. The adjustable hole cleaning device includes retractable vanes which are hydraulically activated to clean cuttings from a hole when the device is in an accumulated cuttings area or "cuttings bed," and hydraulically deactivated when the device is in a non-accumulated cuttings area. The adjustable hole cleaning device may also include a set of port holes which hydraulically open to disperse fluid for cleaning accumulated cuttings in a cuttings bed.

These embodiments of the present invention may be implemented as hydraulic operations that are performed in response to an increase in the hydrostatic pressure of a drilling fluid during the drilling of a wellbore in a subterranean formation. The hydraulic operations may be a mechanical response to the fluid pressure in a drillstring in relation to a tension force within the hole cleaning device, as described below with respect to FIGS. 1–4, or a logical response to an electronic sensor within the device which detects changes in the fluid pressure in the drillstring during drilling. Accordingly, while the discussion below relates to hydraulic operations such as described in FIGS. 1–4, those skilled in the art will appreciate that this discussion is for purposes of example and is not intended to be limiting. For example, electrical or other mechanical activation may be employed to activate the vanes and/or other parts discussed below. Referring now to the drawings, in which like numerals represent like elements through the several figures, aspects of the present invention and the exemplary operating environment will be described.

FIG. 1 illustrates a diagram of a suitable drilling system for practicing the various embodiments of the invention. The drilling system includes a drilling rig 1 for drilling a well having a deviated hole or wellbore 65 through a subtereranean formation 3. The well may be an extended reach well. In one embodiment, the angle of the deviated portion of the wellbore 65 (i.e., from the vertical axis) is greater than 30 degrees. In an alternative embodiment, the deviated portion of the wellbore 65 is horizontal.

The drilling rig 1 may include a drill bit 75 which is supported by a lower end of a drillstring 72 in the wellbore 65. A drive 10 may be provided near an upper end of the drillstring 72 to rotate the drillstring 72 and the drill bit 75 through the subterranean formation 3. The drillstring 72 may comprise a series of interconnected joints of drill pipe. The drillstring 72 may also include one or more hole cleaning devices 90 which may be placed between the interconnected joints of drill pipe. The hole cleaning devices 80 may function to clean accumulated cuttings from "cuttings beds" which may form during drilling operations. The hole cleaning devices 80 will be discussed in greater detail in the discussion of FIGS. 2–4 below. The drillstring 72 may also include a through bore to conduct drilling fluid ("mud") through the drillstring 72.

A mud pump 20 located near the drilling rig 1 may pump the drilling fluid from a drilling fluid reservoir 50 through a mud flow line 40, then through a mud line 30 and into and through the drillstring 72, then through the drill bit 75. The drilling fluid may then exit the drill bit 75 and circulate from the lower end of the wellbore 65, then through an annulus between the drillstring 72 and a wellbore wall 67, and then to the upper end of the wellbore 65. The drilling fluid may then exit the wellbore 65 through a mud return line 70 and into the drilling fluid reservoir 50. While circulating through the wellbore 65, the drilling fluid may carry "cuttings" (i.e., rock pieces) dislodged by the drill bit 75 as it cuts rock in the subterranean formation 3, back to the surface. The drilling fluid reservoir 50 may include a mud treatment system for removing any collected cuttings from the received drilling fluid for recirculation by the mud pump 20.

The drilling fluid may include a fluid density such that sufficient hydrostatic pressure (i.e., "mud weight") is exerted when circulating the fluid through the wellbore 65 preventing formation or "downhole" fluids (i.e., oil, gas, or water) which may be trapped by pressure in the subterranean formation 3, from gushing out to the surface. As the depth of the wellbore 65 increases the formation pressure also increases. As is known to those skilled in the art, a sufficient hydrostatic pressure may be maintained such that it exceeds the formation pressure to prevent the influx of fluids from the wellbore without being so excessive so as to create hydraulic fractures in the formation which may lead to lost circulation. During drilling operations, the mud pump 20 may be utilized to select a drilling fluid circulation rate to increase the fluid density such that sufficient hydrostatic pressure of the drilling fluid is maintained through the drillstring 72. As is known to those skilled in the art, the selected drilling fluid circulation rate may be monitored and/or determined by flow rate sensors (not shown) working in concert with the mud pump 20. The drilling rig 1 may also include a blowout preventer ("BOP") 60 which may include a valve covering the wellbore 65. The valve is closed to prevent the loss of formation fluids from the wellbore 65 in the event a sufficient hydrostatic pressure is not maintained. The operation of BOPs is well known to those skilled in the art.

Figure 2:
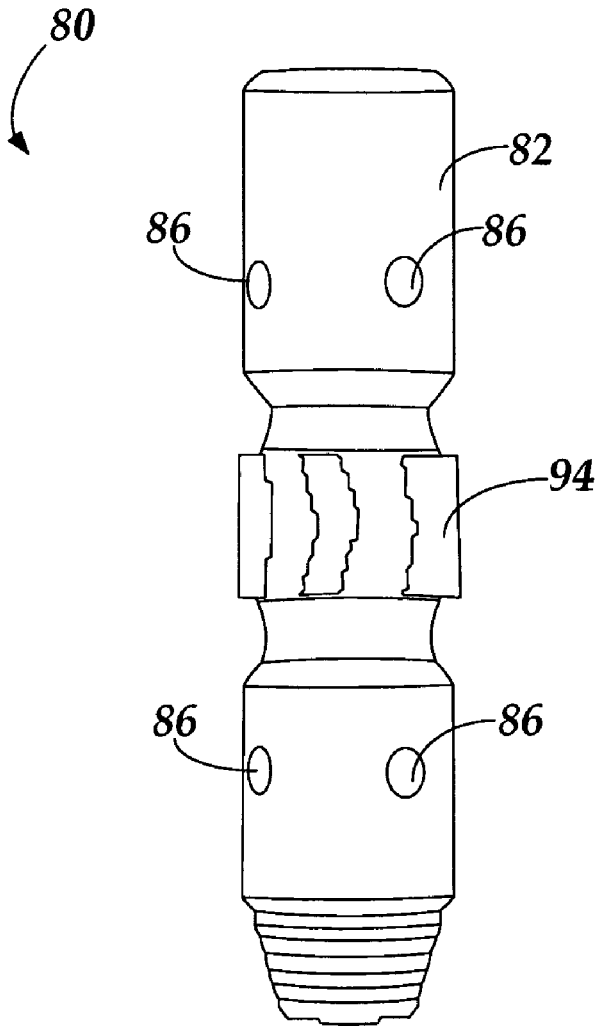
FIG. 2 is a side view of the adjustable hole cleaning device shown in FIG. 1, according to an embodiment of the invention.

FIG. 2 illustrates a side view of a hole cleaning device 80 which may be connected to the drillstring 72 (as shown in FIG. 1), according to one embodiment of the invention. The hole cleaning device 80 includes a cylindrical main body 82 having openings on either end for conducting drilling fluid pumped into the drillstring 72 by the mud pump 20. As shown in FIG. 2, the ends of the main body 82 may include threaded pin and box connections for connecting the hole cleaning device 80 to a standard drillstring. The main body also includes grooves (not shown) for receiving cleaning elements or vanes 94 for clearing cuttings from the wellbore 65 when the drillstring 72 is rotated. The vanes 94 may be connected to a sub-body (not shown) disposed within the main body 82. The vanes 94 and the sub-body will be described in greater detail in the discussion of FIG. 3 below. The main body 82 may further include ports 86 to allow the drilling fluid to bypass the drill bit 75 by diverting the drilling fluid into the annulus of the wellbore 65. It will be appreciated that the main body 82 may comprise a modified diverter sub for implementing the aforementioned ports. Diverter subs are well known to those skilled in the art.

It will be appreciated that alternative configurations of the hole cleaning device 80 may also be utilized without departing from the scope of the above-described embodiments of the invention. For example, in an alternative embodiment, the hole cleaning device 80 may not include the cleaning vanes 94 and may only be provided with the ports 86. In a still further alternative embodiment, the hole cleaning device 80 may not include the ports 86 and may only be provided with the cleaning vanes 94.

Figure 3:
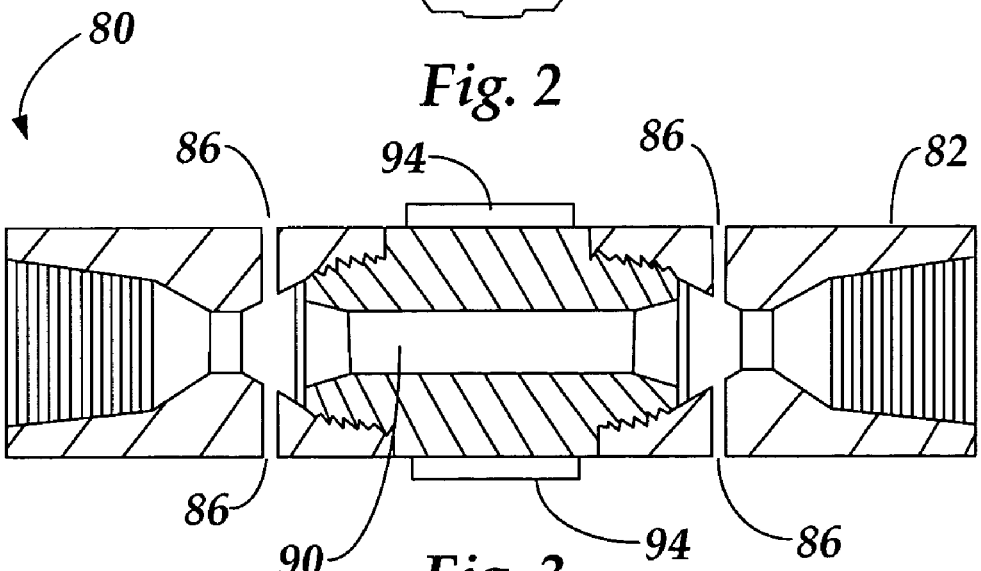
FIG. 3 illustrates a cross-section of the adjustable hole cleaning device shown in FIG. 1, according to an embodiment of the invention.

FIG. 3 illustrates a cross-sectional view of the hole cleaning device 80 described above in FIGS. 1–2, according to an embodiment of the invention. As briefly discussed above in the description of FIG. 2, the hole cleaning device 80 includes a cylindrical sub-body 90. As shown in FIG. 3, the sub-body 90 may be connected to non-receiving ends of the pin and box connections of the main body 82, enabling the sub-body to receive the drilling fluid conducted through the main body from the drillstring 72. Ports 86 extend through the main body 82 and the sub-body 90 to enable the diversion of fluid out of the hole cleaning device 80 and into the annulus of the wellbore 65.

Figure 4A:
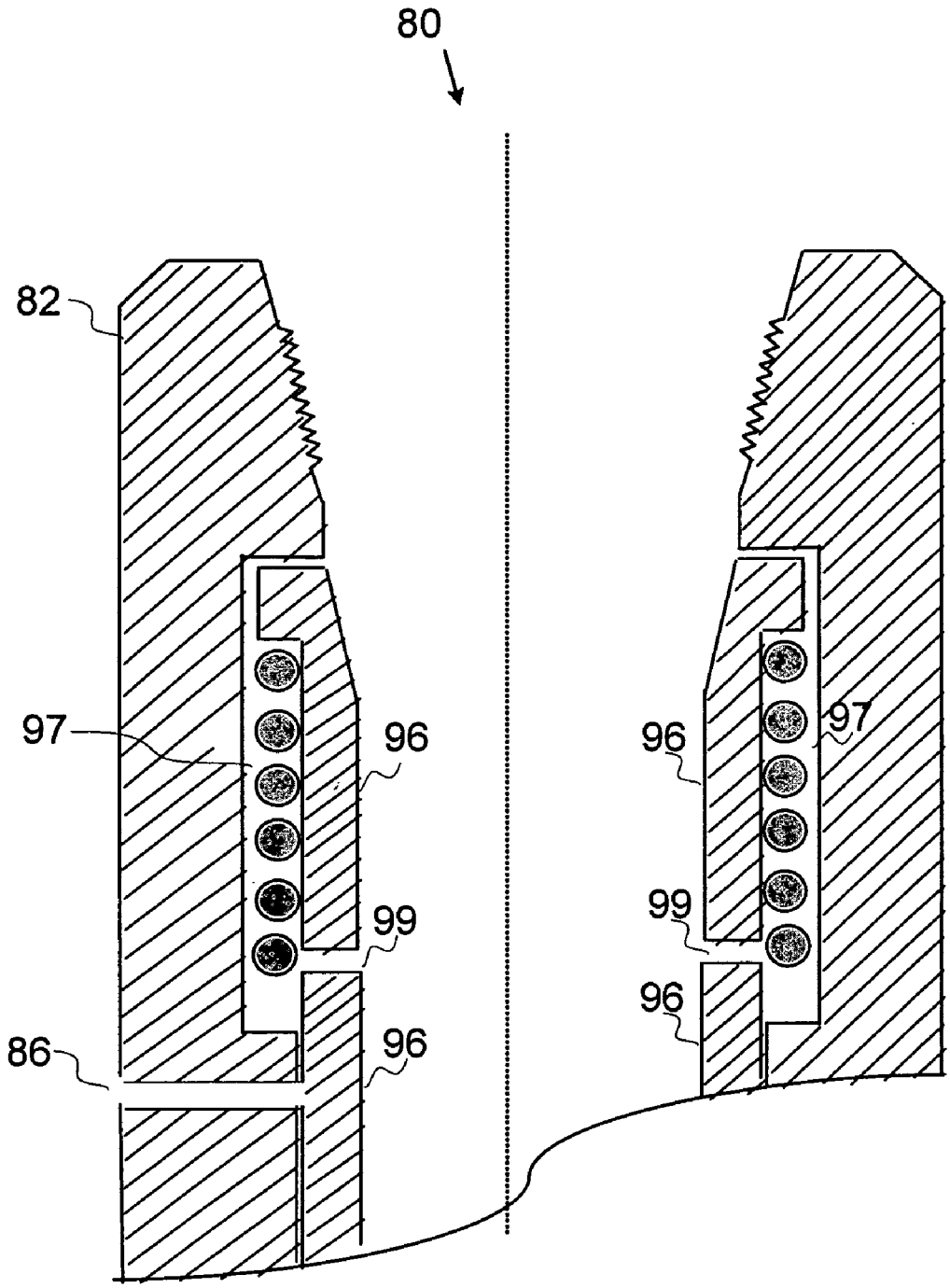
FIG. 4A illustrates a cross-section of a top portion of the adjustable hole cleaning device shown in FIG. 1 in a closed orientation, according to an embodiment of the invention.

FIG. 4A illustrates a cross-sectional view of a top portion of the adjustable hole cleaning device 80 described above in FIGS. 1–2 in a closed orientation, according to an embodiment of the invention. As shown in FIG. 4A, the hole cleaning device 80 includes a sliding sleeve 96 disposed inside of the main body 82 which covers the port 86. It will be appreciated that in alternative embodiments of the invention, the hole cleaning device 80 may include more than one sliding sleeve 96 with each sleeve covering an individual port 86. The sliding sleeve 96 includes an upper portion and a lower portion separated by a sleeve opening 99. The upper portion of the sliding sleeve 96 is retained to a top portion of the main body 82 by a restraining spring 97 which is also disposed inside of the main body 82. The restraining spring 97 may be manufactured to hold the sliding sleeve 96 at a predetermined spring tension or force against the top portion of the main body 82 creating a seal to prevent the leakage of drilling fluid into the wellbore. The predetermined spring tension may be equivalent to the hydrostatic pressure necessary to prevent the influx of formation fluids from the wellbore 65 just before a specified depth is reached by the drill bit 75. It will be appreciated that in the above-described closed orientation of the hole cleaning device 80, the sleeve opening is misaligned with the port opening 86 such that fluid is prevented from escaping the port opening 86. The lower portion of the sliding sleeve 96 and the sleeve opening 99 will be described in greater detail in the description of FIG. 4B below.

Figure 4B:
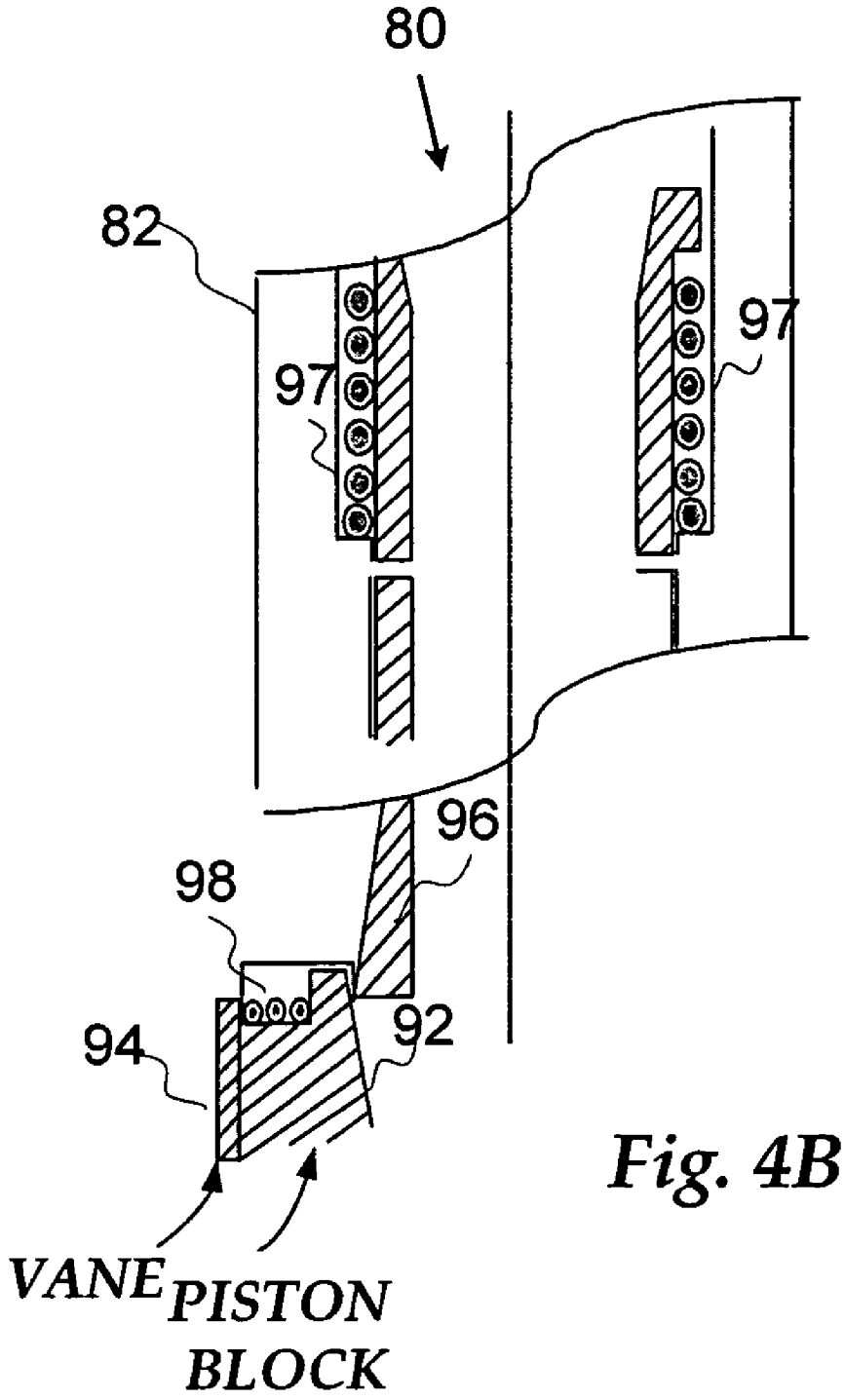
FIG. 4B illustrates a cross-section of a bottom portion of the adjustable hole cleaning device shown in FIG. 1 in a closed orientation, according to an embodiment of the invention.

FIG. 4B illustrates a cross-sectional view of a bottom portion of the adjustable hole cleaning device 80 described above in FIGS. 1–2 in a closed orientation, according to an embodiment of the invention. As shown in FIG. 4B, the lower portion of the sliding sleeve 96 is in contact with a piston block 92 which may be movably connected to the sub-body 90 described in FIG. 3 above. It will be appreciated by those skilled in the art that the piston block 92 may be manufactured from steel or other similar materials. The piston block 92 is connected to a second restraining spring 98 which is shown connected to a cleaning vane 94. Similar to the restraining spring 97 in the top portion of the hole cleaning device 80 discussed above in the description of FIG. 4A, the restraining spring 98 may be manufactured to enable the piston block 92 to hold the cleaning vane 94 at a predetermined spring tension or force. It will be appreciated that in alternative embodiments of the invention, the piston block 92 may be connected to more than one restraining spring 98 with a cleaning vane attached to each spring. The predetermined spring tension may be equivalent to the hydrostatic pressure necessary to prevent the influx of formation fluids from the wellbore 65 just before a specified depth is reached by the drill bit 75. It will be appreciated that the connections between the piston block 92, the restraining spring 98, and the cleaning vane 94 may be made by bolt attachments between these elements.

Figure 5A:
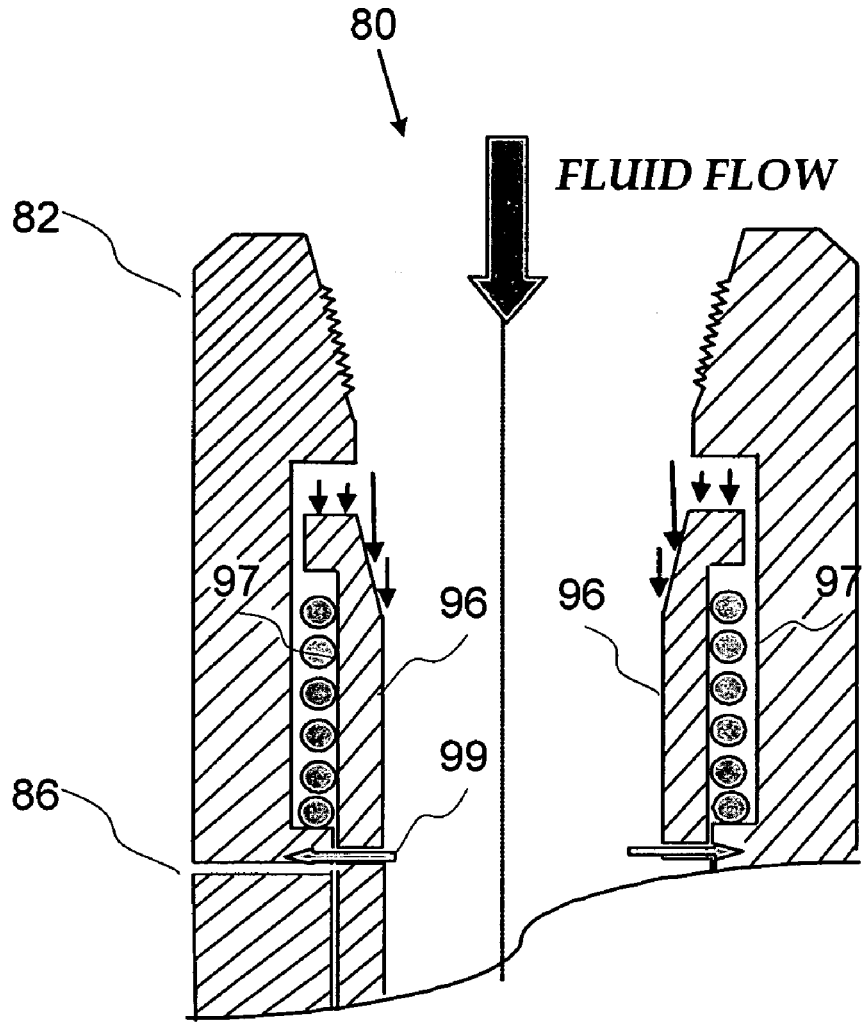
FIG. 5A illustrates a cross-section of a top portion of the adjustable hole cleaning device shown in FIG. 1 in an open orientation, according to an embodiment of the invention.

FIG. 5A illustrates a cross-sectional view of a top portion of the adjustable hole cleaning device 80 shown in FIG. 1 in an open orientation, according to an embodiment of the invention. As shown in FIG. 5A, the top portion of the sliding sleeve 96 is retracted from the main body 82 in response to fluid pressure (represented by downward arrows) from drilling fluid entering into the hole cleaning device 80 from the drillstring 75 such that the sleeve opening 99 is aligned with the port 86 and to allow the drilling fluid to escape into the wellbore. It will be appreciated that the sliding sleeve 96 may be retracted in response to the fluid pressure in the hole cleaning device exceeding the spring tension in the restraining spring 97. The function of the top portion of the hole cleaning device 80 in response to fluid pressure will be described in greater detail in the description of FIGS. 6A and 6B below.

Figure 5B:
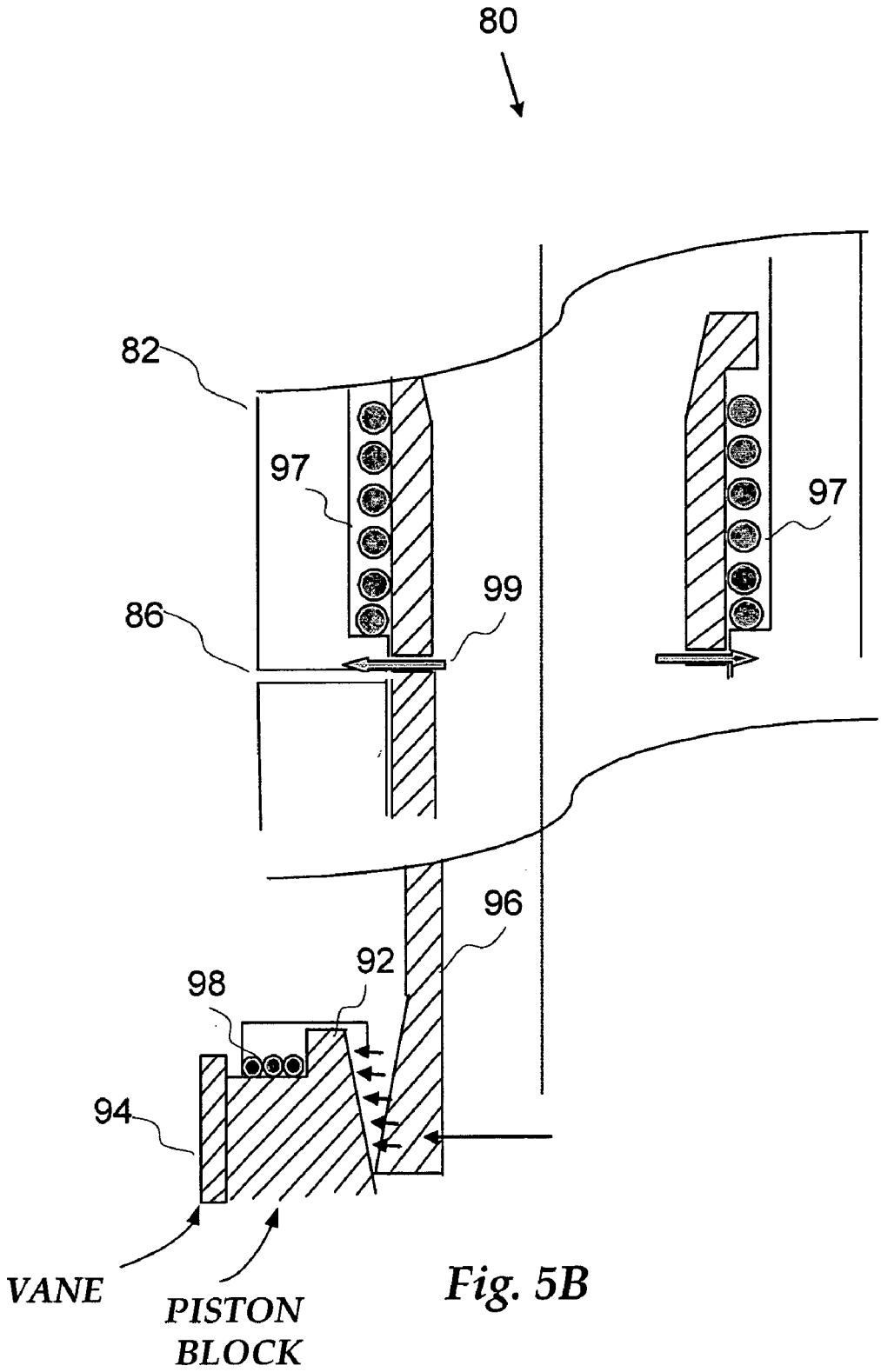
FIG. 5B illustrates a cross-section of a bottom portion of the adjustable hole cleaning device shown in FIG. 1 in an open orientation, according to an embodiment of the invention.

FIG. 5B illustrates a cross-sectional view of a lower portion of the adjustable hole cleaning device 80 shown in FIG. 1 in an open orientation, according to an embodiment of the invention. As shown in FIG. 5B, the bottom portion of the sliding sleeve 96 has retracted downward against the piston block 92 such that a horizontal force (represented by left arrows) is exerted on the piston block 92 to push the piston block 92 against the restraining spring 98 and extend the cleaning vane 94. As discussed above with respect to FIG. 5A, it will be appreciated that the sliding sleeve 96 may be retracted downward in response to the fluid pressure in the hole cleaning device 80 exceeding the spring tension in the restraining springs 97 and 98. The function of the bottom portion of the hole cleaning device 80 in response to fluid pressure will be described in greater detail in the description of FIGS. 6A and 6B below.

Figure 6A:
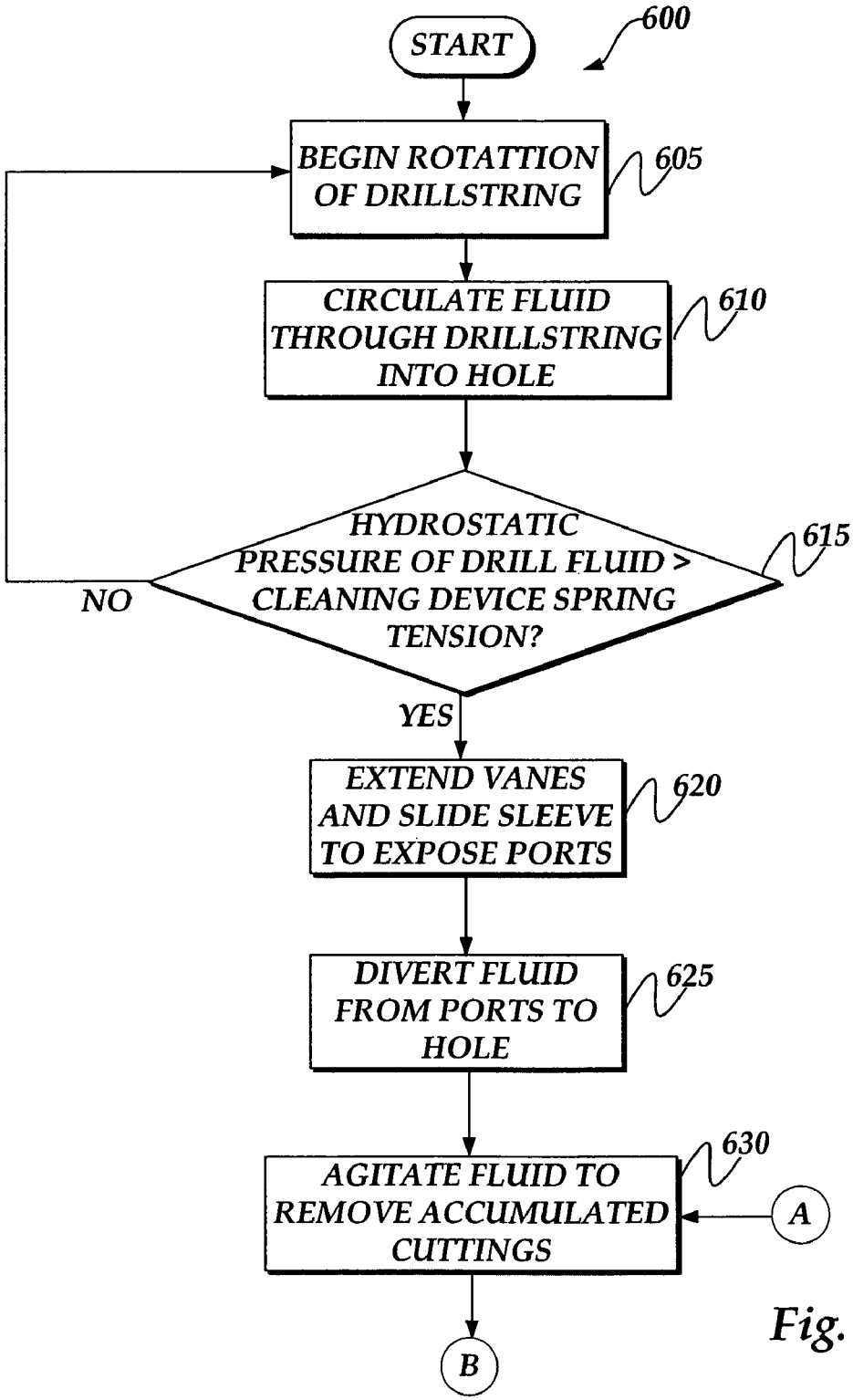
FIG. 6A is a first portion of a flowchart illustrating logical operations performed in utilizing the adjustable hole cleaning device shown in FIGS. 1–5B for cleaning a wellbore, according to an embodiment of the invention.
Figure 6B:
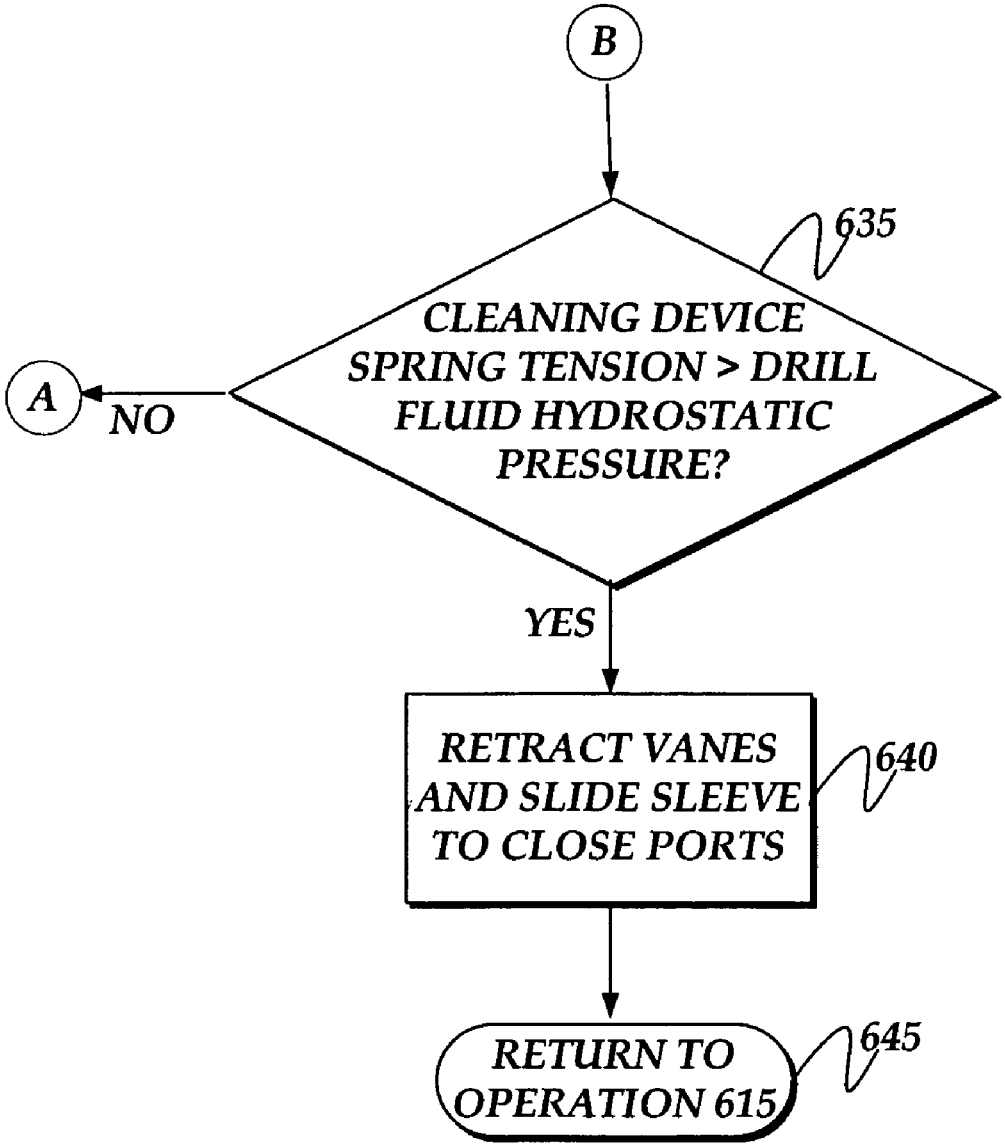
FIG. 6B is a second portion of a flow chart illustrating logical operations performed in utilizing the adjustable hole cleaning device shown in FIGS. 1–5B for cleaning a wellbore, according to an embodiment of the invention

FIGS. 6A and 6B illustrate logical operations performed in utilizing the hole cleaning device 80 for cleaning a wellbore, according to an embodiment of the invention. In the foregoing description, reference will be made to elements of the drilling rig 1 and the hole cleaning device 80, previously discussed above in FIGS. 1–5B. The logical operations of FIGS. 6A and 6B begin at operation 605 where the drive 10 begins rotating the drillstring 72 including the hole cleaning device 80, and the drill bit 75 to drill the deviated wellbore 65 in the subterranean formation 3. It will be appreciated that the hole cleaning device 80 may initially be in the closed orientation discussed with respect to FIGS. 4A–4B above. During drilling operations, the drill bit 75 generates cuttings or dislodged pieces of rock as it cuts rock in the subterranean formation 3. As is known to those skilled in the art, these cuttings typically accumulate to form cuttings beds at the point where the wellbore begins to deviate from the vertical axis.

While drilling the wellbore 65 at operation 605, the mud pump 20 pumps drilling fluid into the drillstring 72 which is circulated through the attached hole cleaning devices 80 and the drill bit 75 into the annulus of the wellbore 65, at operation 610. As discussed above, the mud pump 20 regulates the circulation of the drilling fluid during drilling operations such that a sufficient hydrostatic pressure is exerted to prevent formation fluids from escaping from the wellbore 65. As the depth of the wellbore increases, the circulation rate of the drilling fluid is increased to exert the hydrostatic pressure needed to combat increasing pressure in the subterranean formation 3. During drilling, once the hydrostatic pressure of the drilling fluid exceeds the spring tension in the restraining springs 97 and 98 of the hole cleaning device 80 (operation 615), the hydrostatic pressure causes the piston block 92 to traverse radially, compressing the restraining spring 98, and extend the cleaning vane 94 out from the main body 82 at operation 620. It will be appreciated that at this point, the hole cleaning device 80 may be in the open orientation discussed with respect to FIGS. 5A–5B above.

In addition, while the cleaning vanes 94 are extending outwardly through the grooves in the main body 82, the hydrostatic pressure also causes the restraining spring 97 to compress, causing the sliding sleeve 96 covering the port 86 to slide downward to such that each sleeve opening 99 is aligned with the port 86 creating a openings for the drilling fluid to flow out of the cleaning device 80. Once the openings have been created, the port 86 may divert the drilling fluid passing through the main body 82 from the drillstring 72, directly into the annulus of the wellbore 65. It will be appreciated that the diverted drilling fluid from the port 86 may have a hydrodynamical effect on any cuttings which are present in the wellbore 65. It should be understood that one or more of the ports 86 may be placed in various positions in the main body 82 to create local counter current agitation and turbulence. Those skilled in the art will further appreciate that the port 86 may also serve as a flow diverter to reduce swab and surge pressures while inserting or pulling out the drillstring through narrow clearances in the wellbore.

At operation 630, the extended cleaning vanes 94 agitate the accumulated cuttings and the drilling fluid passed into the wellbore 65 from the drill bit 75 and the port 86, to remove the accumulated cuttings from the cuttings bed and into the axial flow stream which carries the cuttings out of the wellbore 65. At operation 635, after the portion of the drillstring 72 containing the hole cleaning device 80 has passed through an accumulated cuttings area of the well bore 65, the circulation of the drilling fluid through the drillstring 72 by the mud pump 20 is temporarily reduced or stopped, so that the spring tension in the restraining spring 98 exceeds the hydrostatic pressure of the drilling fluid. The reduction in the hydrostatic pressure causes the restraining spring 98 to decompress and retract the cleaning vane 94 back into the main body 82. In addition, while the cleaning vane 94 is being retracted, the reduction in hydrostatic pressure also causes the restraining spring 97 to decompress and push the sliding sleeve 96 upward to cover the port 86. Thus, the hole cleaning device is reverted back to the closed orientation shown in FIGS. 4A–4B. The logical operations of FIG. 4 then return to operation 615 at operation 645.

It will be appreciated that in the above-described embodiments of the invention, the spring tension may be calculated to withstand hydrostatic pressure at a depth just prior to the beginning of the deviation of the wellbore 92 to maximize cleaning efficiency. For example, if a well is to be drilled having a deviation beginning at 900 feet, the spring tension of the restraining springs 97 and 98 may be calculated to withstand the hydrostatic pressure of the drilling fluid necessary to prevent the influx of formation fluids at this depth. Such calculations are known to those skilled in the art. Once this depth is exceeded (and the hydrostatic pressure necessarily increased) the spring tension in the springs will be overcome and the cleaning vane will be extended as discussed above in operation 620. In this manner, cuttings beds, which typically form in the deviated portion of a wellbore, may be effectively agitated into the circulating drilling fluid by the cleaning vane and subsequently removed from the hole. It will further be appreciated that once the hole cleaning device 80 has passed through a cuttings bed, the retraction of the cleaning vane 94 prevents the exertion of additional torque and drag on the drillstring 72, thus facilitating drilling in non-accumulating cuttings areas.

In one illustrative embodiment, the hole cleaning device 80 may only include the restraining spring 98 disposed between the piston block 92 and the vane 94. In this embodiment, the restraining spring 98 may support both the upper and lower portions of the sliding sleeve 96 until the hydrostatic or fluid pressure in the hole cleaning device exceeds the spring tension. When the spring tension is exceeded the restraining spring 98 is compressed causing both the extension of the vane 94 from the device and the separation of the piston block 92 from the lower portion of the sliding sleeve 96 which will also cause the upper portion of the sliding sleeve 96 to drop and uncover the port 86 (i.e., by aligning the sleeve opening with the port). When the fluid pressure is reduced below that of the spring tension in the restraining spring 98, the spring is decompressed causing the retraction of the vane 94 and the pushing of the piston block against the lower portion of the sliding sleeve 96 causing the sleeve to slide upward and cover the port 86.

In another illustrative embodiment, the hole cleaning device 80 may only include the restraining spring 97 disposed between upper portion of the sliding sleeve 96 and the inside of the main body 82. In this embodiment, the lower portion of the sliding sleeve 96 may be slidably connected with the piston block 92 (e.g., in a tongue-and-groove configuration) and the vane 94 may be directly connected to the piston block 94. When the hydrostatic or fluid pressure in the hole cleaning device 80 exceeds the tension in the restraining spring 97, the spring is compressed causing the lower portion of the sleeve to slide downward and laterally push the piston block 92 to extend the vane 94 out from the hole cleaning device 80. When the fluid pressure is reduced below that of the spring tension in the restraining spring 97, the spring is decompressed causing the sliding sleeve 96 to slide upward (covering the port 86) and the piston block 92 (and the connected vane 94) to retract.

Figure 7:
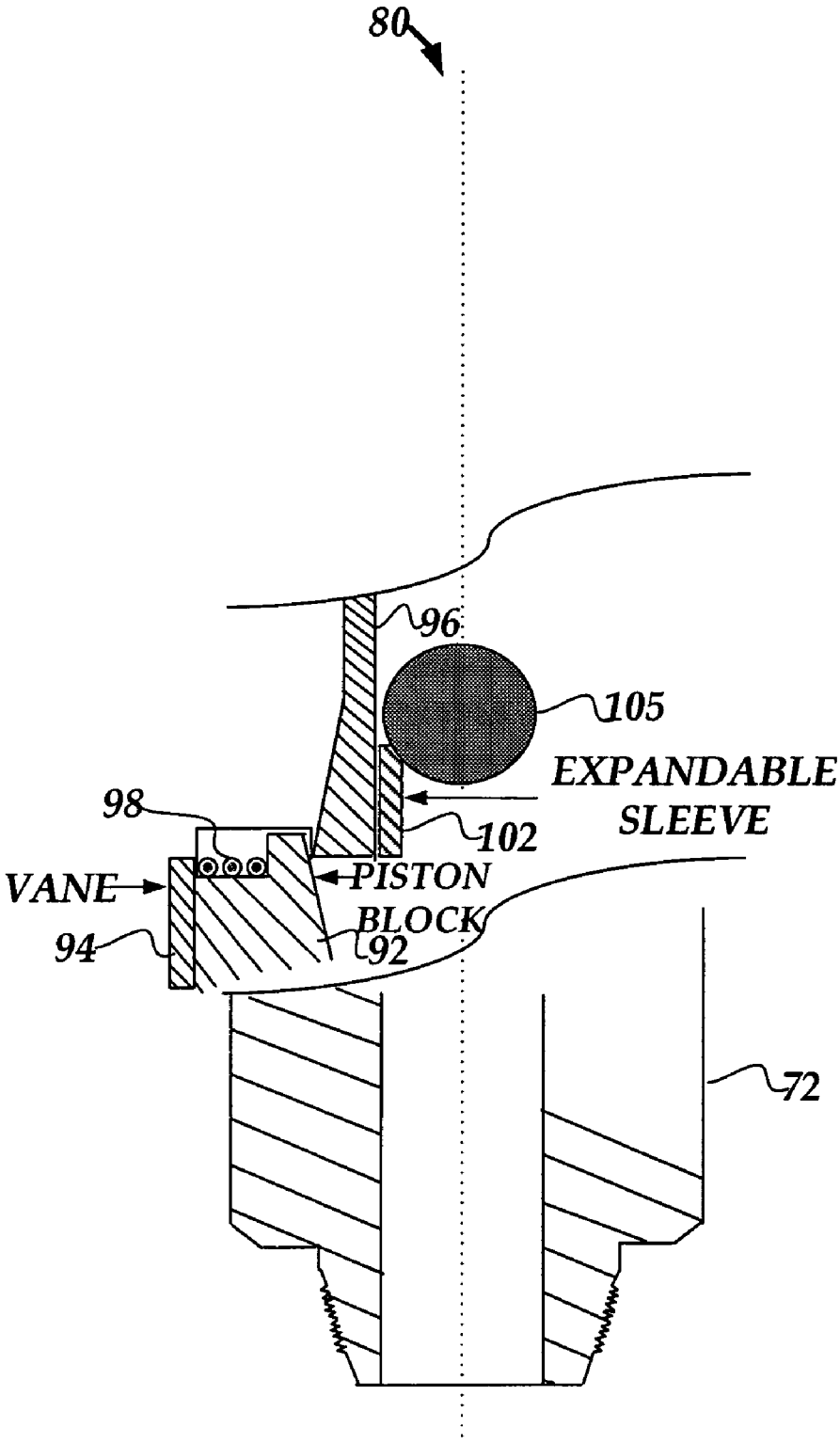
FIG. 7 illustrates a cross-section of a bottom portion of the adjustable hole cleaning device shown in FIG. 1 prior to being deactivated, according to an embodiment of the invention.
Figure 9:
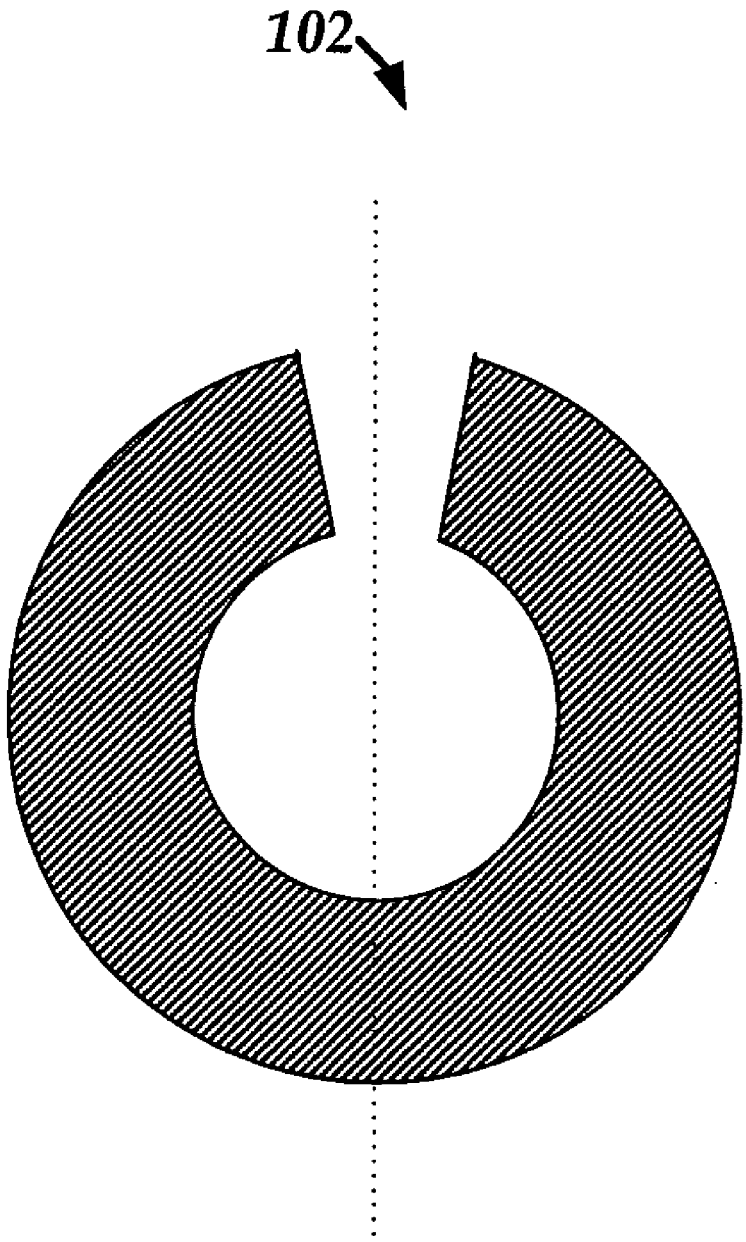
FIG. 9 shows a cross-section of the expandable sleeve illustrated in FIGS. 7–8 in a normal orientation, according to an embodiment of the invention.
Figure 10:
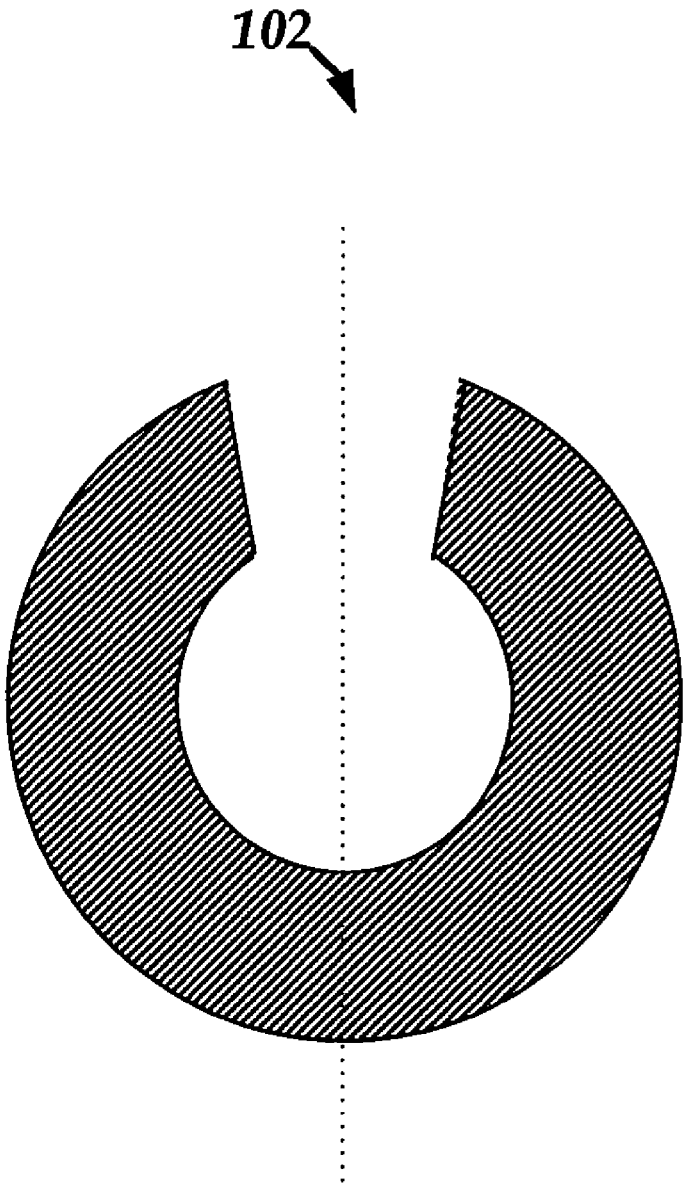
FIG. 10 shows a cross-section of the expandable sleeve illustrated in FIGS. 7–8 in an expanded orientation, according to an embodiment of the invention.

In an alternative embodiment of the invention, the adjustable hole cleaning device may be manually deactivated (i.e., maintained in a closed orientation) by dropping an object, such as a steel ball, down the drillstring and into the hole cleaning device to prevent the cleaning vanes from extending when the fluid or hydrostatic pressure in the adjustable hole cleaning device exceeds the tension in the restraining spring. FIG. 7 illustrates a cross-section of a bottom portion of the adjustable hole cleaning device 80 just before being deactivated according to the aforementioned embodiment. As shown in FIG. 7, the lower portion of the sliding sleeve 96 is in contact with the piston block 92 and proximate to an expandable sleeve 102 which is compressed against the sliding sleeve 96. It should be understood that the expandable sleeve 102 is capable of having both normal and expanded orientations. FIG. 9 shows a cross-section of the expandable sleeve 102 in a normal orientation while FIG. 10 shows a cross-section of the expandable sleeve in an expanded orientation according to embodiments of the invention. Similar to the sliding sleeve 96 described above with respect to FIGS. 4–5, the expandable sleeve 102 may be spring-loaded.

Returning now to FIG. 7, the adjustable hole cleaning device 80 may be deactivated by dropping a ball 105 into the drillstring 72 during drilling operations. Once the dropped ball 105 enters the adjustable hole cleaning device 80 it temporarily comes to rest against the expandable sleeve 102. While the ball 105 is resting against the expandable sleeve 102, the hydrostatic pressure of the fluid circulating through the drillstring 72 (and consequently the adjustable hole cleaning device 80) is applied over the ball 105. It will be appreciated that the applied pressure exerted by the fluid over the ball 105 is greater than the applied pressure exerted by the fluid at the top of the piston block 92. The applied fluid pressure acts downward on the ball 105 resulting in the expandable sleeve 102 being pushed downward and past the sliding sleeve 96 as shown in FIG. 8 which will be described below.

Figure 8:
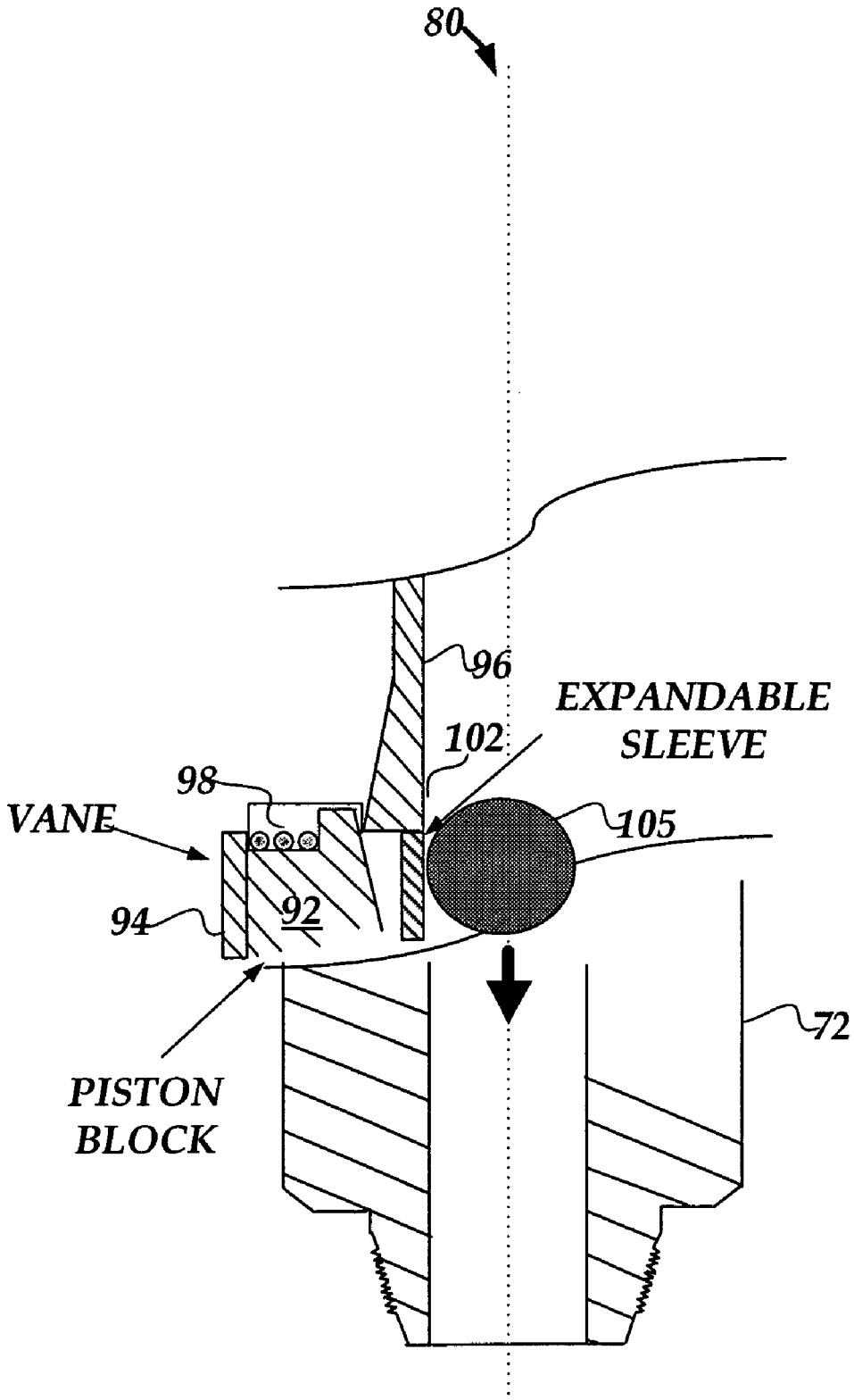
FIG. 8 illustrates a cross-section of a bottom portion of the adjustable hole cleaning device shown in FIG. 1 after being deactivated, according to an embodiment of the invention.

FIG. 8 illustrates a cross-section of a bottom portion of the adjustable hole cleaning device 80 after being deactivated according to an embodiment of the invention. As shown in FIG. 8, once the expandable sleeve 102 has been pushed past the sliding sleeve 96 by the ball 105, the expandable sleeve 102 expands under the sliding sleeve 96. When the expandable sleeve 102 is under the sliding sleeve 96, the sliding sleeve 96 is prevented from sliding downward in response to the hydrostatic pressure in the adjustable hole cleaning device 80 exceeding the tension in the restraining springs 97 and 98 (as shown in FIGS. 4–5). As a result, the port 86 will remain closed and the piston block 92 (and the connected vane 94) will remain retracted.

Once the expandable sleeve 102 expands under the sliding sleeve 96, the ball 105 continues to pass through the adjustable hole cleaning device 80 and may pass through other devices (if present) attached to the drillstring 72 to deactivate them as well. It will be appreciated that a ball catcher (not shown) may be placed at the bottom of the last tool in the drillstring 72 so that the ball does not block the fluid flow. Ball catcher devices are known to those skilled in the art. It will be appreciated that objects may also be dropped down the drillstring 72 to deactivate the hole cleaning device 80. For example, instead of the ball 105, a drop bar or cylinder may be used to deactivate the hole cleaning device 80.

Although the present invention has been described in connection with various illustrative embodiments, those of ordinary skill in the art will understand that many modifications can be made thereto within the scope of the claims that follow. Accordingly, it is not intended that the scope of the invention in any way be limited by the above description, but instead be determined entirely by reference to the following claims.

What is claimed is:

1. A method of cleaning a hole in a subterranean formation, the method comprising:

rotating a drillstring to drill a hole through the subterranean formation, wherein the drillstring includes at least one cleaning device;

while rotating the drillstring, circulating fluid through the drillstring into the hole; and in response to an increase in a hydrostatic pressure of the fluid in the drillstring, extending at least one adjustable vane away from the at least one cleaning device to clean accumulated cuttings from the drilled hole.

2. The method of claim 1, wherein extending the at least one adjustable vane from the at least one cleaning device comprises extending the at least one adjustable vane when the hydrostatic pressure of the fluid in the drillstring exceeds a spring tension force in the cleaning device.

3. The method of claim 1, further comprising utilizing the at least one adjustable vane on the at least one cleaning device to agitate the fluid in the hole to remove the accumulated cuttings.

4. The method of claim 1, further comprising, in response to a decrease in a hydrostatic pressure of the fluid in the drillstring, retracting the at least one adjustable vane into the at least one cleaning device.

5. The method of claim 4, further comprising retracting the at least one adjustable vane into the at least one cleaning device when a spring tension force in the at least one cleaning device exceeds the hydrostatic pressure of the fluid in the drillstring.

6. The method of claim 1, further comprising, in response to an increase in a hydrostatic pressure of the fluid in the drillstring, opening a plurality of ports in the cleaning device to divert the fluid from the drillstring into the drilled hole.

7. The method of claim 6, further comprising, in response to a decrease in the hydrostatic pressure of the fluid in the drillstring, closing the plurality of ports in the cleaning device.

8. The method of claim 1, further comprising agitating the fluid with the at least one adjustable vane to remove the accumulated cuttings from the drilled hole.

9. The method of claim 1, wherein the drilled hole is deviated.

10. The method of claim 9, wherein the deviated hole has an inclination greater than 30 degrees.

11. The method of claim 4, further comprising, after retracting the at least one adjustable vane into the at least one cleaning device, deactivating the at least one cleaning device.

12. The method of claim 11, wherein deactivating the at least one cleaning device comprises dropping an object through the drillstnng to an expandable sleeve in the at least one cleaning device, wherein the object exerts a downward force on the expandable sleeve to expand the sleeve thereby preventing the extension of the at least one cleaning element when the hydrostatic pressure of the fluid in the drillstring exceeds a spring tension force in the cleaning device.

13. The method of claim 12, wherein the object is at least one of a ball, a drop bar, or a cylinder.

14. A hole cleaning device, comprising:

at least one cleaning element for cleaning debris from a hole;

a body for conducting fluid, the body comprising at least one opening for receiving the at least one cleaning element;

at least one restraining spring disposed within the body, wherein the at least one restraining spring is connected to the at least one cleaning element to restrain the at least one cleaning element at a spring tension; and a block for pushing the at least one restraining spring such that the at least one cleaning element is extended through the at least one opening in the body in response to a fluid pressure in the body exceeding the spring tension of the at least one restraining spring, wherein the at least one cleaning element is an adjustable vane.

15. The hole cleaning device of claim 14, wherein the body further comprises at least one port for diverting the fluid from the body into the hole.

16. The hole cleaning device of claim 15, further comprising:

a sliding sleeve proximate to the at least one restraining spring and the block in the body, wherein in response to the fluid pressure in the body exceeding the spring tension force of the at least one restraining spring, the sliding sleeve slides downward to open the at least one port for diverting the fluid from the body into the hole.

17. The hole cleaning device of claim 16, further comprising an expandable sleeve proximate to the sliding sleeve, for preventing the extension of the at least one cleaning element when the fluid pressure in the body exceeds the spring tension of the at least one restraining spring.

18. The hole cleaning device of claim 16, wherein the at least one restraining spring pulls the at least one cleaning element such that the at least one cleaning element is retracted through the at least one opening in the body, in response to the spring tension of the at least one restraining spring exceeding the fluid pressure in the body.

19. The hole cleaning device of claim 18, wherein in response to the spring tension force of the at least one restraining spring exceeding the fluid pressure in the body, the sliding sleeve slides upward to close the at least one port for diverting the fluid from the body into the hole.

20. The hole cleaning device of claim 14, wherein the body further comprises a top end, the top end having a pin connection for receiving the fluid, and a bottom end, the bottom end having a box connection for dispersing the fluid.

21. The hole cleaning device of claim 14, wherein the body is capable of rotation.

22. The hole cleaning device of claim 14, wherein the at least one cleaning element cleans the debris from the hole by agitating the fluid and debris in the hole when the body is rotated.

23. A system for clearing cuttings from a wellbore in a subterranean formation, the system comprising:

a drillstring for conducting and circulating fluid;

a drill bit connected to an end of the drillstring for receiving the fluid from the drillstring and conducting and circulating the fluid into the wellbore; and at least one cleaning device attached along a length of the drillstring, the cleaning device comprising:

a plurality of adjustable vanes;

a main body comprising a plurality of grooved openings for receiving the plurality of adjustable vanes and a plurality of ports for diverting the fluid from the drillstring into the wellbore;

a sub-body, disposed within the main body for receiving the fluid from the main body;

a sliding sleeve disposed within the sub-body;

a first plurality of restraining springs disposed within the sub-body;

a second plurality of restraining springs disposed within the sub-body, wherein the second plurality of restraining springs are connected to the plurality of adjustable vanes to restrain the plurality of adjustable vanes at a spring tension; and a piston block, disposed within the sub-body and proximate to the second plurality of restraining springs; and a sliding sleeve proximate to the second plurality of restraining springs and the piston block wherein in response to a hydrostatic pressure of the fluid in the drill bit exceeding the spring tension force in the cleaning device, the sliding sleeve slides downward compressing the first plurality of restraining springs to open the plurality of ports for diverting the fluid from the drillstring into the wellbore, and the sliding sleeve pushes the piston block against the first plurality of restraining springs to extend the plurality of adjustable vanes through the plurality of grooved openings in the main body and into the wellbore to clear the cuttings, and wherein in response to the spring tension force in the cleaning device exceeding the hydrostatic pressure of the fluid in the cleaning device, the sliding sleeve slides upward uncompressing the first plurality of restraining springs to close the plurality of ports for diverting the fluid from the drillstring into the wellbore and causes the second plurality of restraining strings to retract the plurality of adjustable vanes through the plurality of grooved openings and into the main body.

24. The system of claim 23 further comprising an expandable sleeve proximate to the sliding sleeve, for blocking movement of the sliding sleeve thereby preventing the extension of the plurality of adjustable vanes when a hydrostatic pressure of fluid in the drill bit exceeds the spring tension force in the cleaning device.

25. A hole cleaning device, comprising:

at least one cleaning element for cleaning debris from a hole;

a body for conducting fluid, the body comprising at least one opening for receiving the at least one cleaning element;

at least one restraining spring disposed within the body, wherein the at least one restraining spring is connected to the at least one cleaning element to restrain the at least one cleaning element at a spring tension;

a block for pushing the at least one restraining spring such that the at least one cleaning element is extended through the at least one opening in the body in response to a fluid pressure in the body exceeding the spring tension of the at least one restraining spring; and a sliding sleeve proximate to the at least one restraining spring and the block in the body, wherein in response to the fluid pressure in the body exceeding the spring tension force of the at least one restraining spring, the sliding sleeve slides downward to open the at least one port for diverting the fluid from the body into the hole.

* * * * *